United States Patent [19]

Mockel

[11] 4,253,211

[45] Mar. 3, 1981

[54] TOILET BOWL CLEANING APPARATUS

[76] Inventor: Fred Mockel, Box 80, Rte. 2, Williston, N. Dak. 58801

[21] Appl. No.: 82,117

[22] Filed: Oct. 5, 1979

[51] Int. Cl.[3] ..... B08B 9/02; A47K 11/10

[52] U.S. Cl. ..... 15/104.3 G; 15/105; 4/257

[58] Field of Search ..... 15/104.165, 104.3 G, 15/105; 4/255

[56] References Cited

U.S. PATENT DOCUMENTS

| | | | |
|---|---|---|---|
| 1,051,992 | 2/1913 | Fisher et al. | 15/104.3 G |
| 1,061,119 | 5/1913 | P'Pool | 15/104.165 |

*Primary Examiner*—Edward L. Roberts

*Attorney, Agent, or Firm*—Robert S. Smith

[57] ABSTRACT

Apparatus for cleaning a toilet bowl which comprises a generally u-shaped member having first and second legs which are joined by an arcuate axial portion. The first leg has a sharp point thereon and a weight is disposed on the second leg. An elongated flexible member is fixed to the free end of the second leg and a swab is fixed to the other end of the elongated flexible member.

6 Claims, 1 Drawing Figure

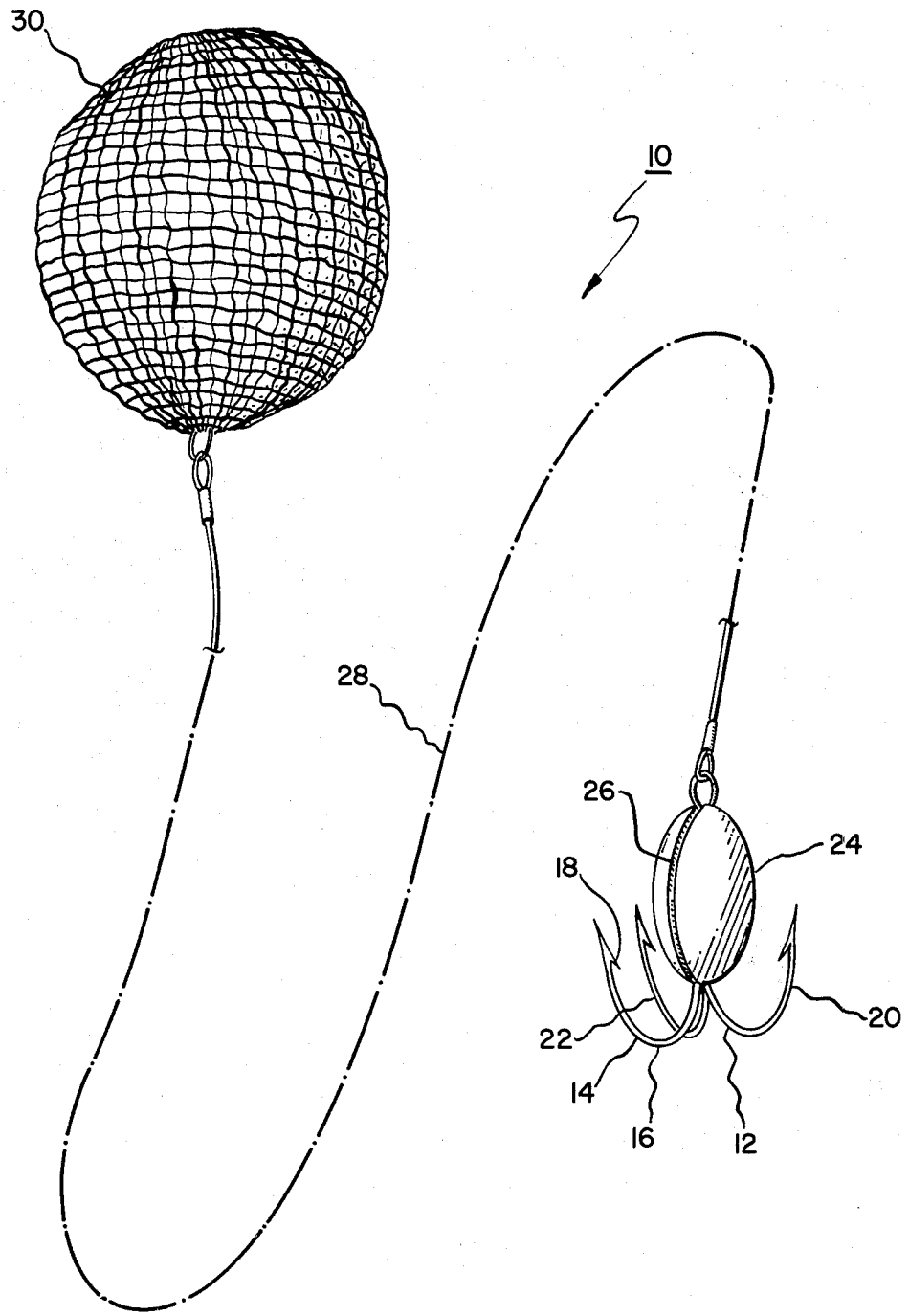
30
10
28
26
24
18
20
22
14
16
12

TOILET BOWL CLEANING APPARATUS

BACKGROUND OF THE INVENTION

The invention relates to cleaning apparatus and particularly to apparatus for cleaning toilet bowls. The prior art teaches a variety of brushes and plumber's snakes which are useful for the purpose of cleaning pipes and toilet bowls. The serpentine path within the toilet bowl creates considerable difficulty when that path becomes obstructed. More particularly the path makes it extremely difficult to guide any object through the passageway. The problem is, of course, much more acute when there is an obstruction in the passageway.

A secondary problem is the difficulty of cleaning both fibrous objects such as rags and sanitary napkins from the bowl as well as relatively hard objects such as hard plastic combs and the like.

It is an object of the invention to provide apparatus which will negotiate through the passageway within a toilet bowl despite the presence of obstructions.

It is another object of the invention to provide apparatus which will in addition dislodge and readily facilitate the romoval of such obstructions even though they may have a wide variety of shapes and may be made of wide variety of materials.

SUMMARY OF THE INVENTION

It has now been found that these and other objects of the invention may be attained in a toilet bowl cleaning apparatus which includes a generally u-shaped member having first and second legs which are joined by an arcuate axial portion. The first leg has a sharp point thereon and a weight is disposed on the second leg. An elongated flexible member has one end fixed to the free end of the second leg and a swab is fixed to the other end of the elongated flexible member.

In one form of the apparatus second and third u-shaped members each have first and second legs joined by an arcuate axial portion. Each of the first legs is fixed to the first leg of every other u-shaped member in parallel side abutting relationship with the second legs each extending in the same direction. In one form the first, second and third u-shaped members may comprise a fishing hook having a barb at each point.

The weight may comprise an elongated lead member having an axial swab therein. The swab may comprise a sponge. The elongated flexible member amy comprise a cable.

BRIEF DESCRIPTION OF THE DRAWING

The invention will be better understood by reference to the accompanying drawing in which there is shown an elevational view of the apparatus in accordance with one form of the invention.

DESCRIPTION OF A PREFERRED EMBODIMENT

Referring now to the drawing there is shown apparatus 10 for cleaning a toilet bowl. The apparatus includes a hook 12 which comprises at least one generally u-shaped member having first and second legs 12, 14 joined by an arcuate axial portion 16. The free end of the leg 14 is pointed and may be provided with a barb 18. In one form of the invention the apparatus further includes second and third u-shaped members 20 and 22 which are disposed with the first legs each disposed in the same direction. In one additional form of the invention the u-shaped members may merely be portions of the convention treble fishing hook. In those forms of the invention it has been found that a hook which is identified as a #3 size functions particularly well. Carried on the shank of the fishing hook or alternatively the second leg 12 of each of the u-shaped members is a weight 24 which preferably is elongated and has an axial slit or slot 26 which engages the u-shaped members. Connected to the right end (as viewed) of the second legs or treble hook is a flexible elongated member 28 which preferably is a flexible cable. In other forms of the invention a chain having a plurality of links may be used.

Connected securely to the right end (as viewed) of cable 28 is a swab 30. The swab may be a quantity of flexible material which may be absorbent and may, for example, be cotton, nylon, polyester or other fibrous material. In the preferred form of the invention the swab will be a sponge material of either a natural or synthetic type.

The size of the weight 24 may vary, however, it has been found that a weight having the diameter of $\frac{5}{8}$ inch and the length of 1 inch is particularly desirable. Although a cable 28 is preferred it will be understood that a wire, string, rope or chain may also be used.

In operation the toilet bowl is removed from its mounting and is inverted. Thereafter the weighted end of the apparatus in accordance with the invention is placed in the opening which is ordinarily at the bottom of the toilet bowl. Then the toilet bowl is slowly rocked about a horizontal axis as the weight is allowed to proceed further along the passageway within the toilet bowl. The weight will knock out or proceed by any material plugging the toilet bowl. In some cases the pointed ends of the u-shaped members will engage matter within the toilet bowl and will then be dislodged by pulling the cable upwards. In other cases the weight 24 when moving within the passageway within the toilet bowl will impact against an obstruction and cause the passageway to be cleared merely by the impact. In still other cases the weight 24 will slide past an obstruction and will proceed completely through the passageway within the toilet bowl. The user may then pull on the cable 28 to force the swab 30 through the passageway and insure that the passageway is completely cleared.

It will be seen that almost any kind of debris or obstruction which may be lodged within the toilet including but not limited to rags, sanitary napkins, combs and the like will be dislodged by the effects of either the u-shaped member, the weight, or the swab 30. The combination of the three results in apparatus which cooperate with each other. It will be understood that in many situations it is not known what is blocking the passageway within the toilet and therefore the apparatus in accordance with the invention is particularly convenient since it will deal with a wide variety of sizes and materials.

Having thus described my invention I claim:

1. Apparatus for cleaning a toilet bowl which comprises:

a generally u-shaped member having first and second legs joined by an arcuate axial portion, said first leg having a sharp point thereon, a weight disposed on said second leg, an elongated flexible member having one end fixed to the free end of said second leg and a swab fixed to the other end of said elongated flexible member.

2. The apparatus as described in claim 1 wherein said apparatus further includes second and third u-shaped members each having first and second legs joined by an arcuate axial portion, each of said first legs being fixed to said first legs of every other u-shaped member in parallel side abutting relationship with said second legs each extending in the same direction.

3. The apparatus as described in claim 2 wherein said first, second, and third u-shaped members comprise a fishing hook having a barb at each point thereof.

4. The apparatus as described in claim 3 wherein said weight comprises an elongated lead member having an axial slot therein accommodating each of said first members.

5. The apparatus as described in claim 4 wherein said swab comprises a sponge.

6. The apparatus as described in claim 5 wherein said flexible elongated member comprises a cable.

* * * * *